US007808461B2

(12) United States Patent
Yamazaki et al.

(10) Patent No.: US 7,808,461 B2
(45) Date of Patent: Oct. 5, 2010

(54) IMAGE DISPLAY APPARATUS

(75) Inventors: Tatsuro Yamazaki, Tokyo (JP); Naoto Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1350 days.

(21) Appl. No.: 11/059,660

(22) Filed: Feb. 17, 2005

(65) Prior Publication Data

US 2005/0190119 A1 Sep. 1, 2005

(30) Foreign Application Priority Data

Feb. 27, 2004 (JP) ..... 2004-055400
Feb. 3, 2005 (JP) ..... 2005-027351

(51) Int. Cl.
*G09G 3/32* (2006.01)

(52) U.S. Cl. ..... 345/82; 345/63; 345/89; 345/690; 315/169.1; 315/169.3

(58) Field of Classification Search ..... 345/87, 345/89, 100, 103, 107, 204, 211–213, 76, 345/77, 690–693, 60, 63, 82, 83; 315/169.1–169.3
See application file for complete search history.

(56) References Cited

U.S. PATENT DOCUMENTS

| | | | | |
|---|---|---|---|---|
| 5,659,329 | A | 8/1997 | Yamanobe et al. | 345/74 |
| 5,818,403 | A | 10/1998 | Nakamura et al. | 345/74 |
| 5,844,534 | A * | 12/1998 | Okumura et al. | 345/90 |
| 5,874,933 | A | 2/1999 | Hirai et al. | |
| 6,020,868 | A | 2/2000 | Greene et al. | 345/88 |
| 6,265,833 | B1 * | 7/2001 | Kim et al. | 315/169.3 |
| 6,624,586 | B2 | 9/2003 | Abe et al. | 315/169.1 |
| 6,653,794 | B2 | 11/2003 | Sagano et al. | 315/169.2 |
| 6,842,160 | B2 | 1/2005 | Yamazaki et al. | 345/76 |
| 6,847,338 | B2 | 1/2005 | Abe et al. | 345/60 |
| 6,870,522 | B2 | 3/2005 | Sagano et al. | 345/75.2 |
| 7,009,627 | B2 * | 3/2006 | Abe et al. | 345/690 |
| 7,176,912 | B2 * | 2/2007 | Kota et al. | 345/211 |
| 2002/0033830 | A1 | 3/2002 | Yamakawa | 345/600 |
| 2002/0171608 | A1 | 11/2002 | Kanai et al. | 345/55 |

(Continued)

FOREIGN PATENT DOCUMENTS

EP 1 310 935 A2 5/2003

(Continued)

*Primary Examiner*—Richard Hjerpe
*Assistant Examiner*—Jennifer T Nguyen
(74) *Attorney, Agent, or Firm*—Fitzpatrick, Cella, Harper & Scinto

(57) ABSTRACT

An image display apparatus according to the present invention includes: n of scanning lines, n being an integer of 3 or greater; a scanning circuit that outputs a selection signal for sequentially selecting scanning lines from the n of scanning lines in each transitional selection period, light being to be emitted onto the selected scanning lines; a plurality of display devices that are to form a plurality of pixels that form the plurality of scanning lines; an evaluation circuit that outputs an evaluation value corresponding to the brightness of an image formed by the pixels of each of the plurality of display devices; and a control circuit that changes scanning conditions in the scanning circuit in accordance with the evaluation value, so that the ratio of the total time in term of a unit time of the time when each of the n of scanning lines being selected during the selection periods to the unit time is changed.

5 Claims, 10 Drawing Sheets

U.S. PATENT DOCUMENTS

| | | | | |
|---|---|---|---|---|
| 2003/0006976 | A1 | 1/2003 | Sagano et al. | 345/204 |
| 2003/0011537 | A1 | 1/2003 | Dunphy et al. | 345/30 |
| 2003/0095085 | A1 | 5/2003 | Abe | 345/74.1 |
| 2003/0107542 | A1 | 6/2003 | Abe et al. | 345/89 |

FOREIGN PATENT DOCUMENTS

| | | | |
|---|---|---|---|
| JP | 63-306495 | | 12/1988 |
| JP | 6-342636 | | 12/1994 |
| JP | 8-212944 | | 8/1996 |
| JP | 2000-267624 | | 9/2000 |
| JP | 2004-32000 | | 1/2004 |
| WO | WO 2004-042688 | A1 | 5/2004 |

* cited by examiner

EXAMPLES OF SCANNING CONTROL SIGNALS
IN THE SCANNING MODE SHOWN IN FIG. 3

EXAMPLES OF SCANNING CONTROL SIGNALS
IN THE SCANNING MODE SHOWN IN FIG. 4

EXAMPLES OF SCANNING CONTROL SIGNALS
IN THE SCANNING MODE SHOWN IN FIG. 6

IMAGE DISPLAY APPARATUS

BACKGROUND OF THE INVENTION

1. Field of the Invention

The present invention relates to an image display apparatus.

2. Description of the Related Art

Examples of such image display apparatuses are disclosed in Japanese Patent Application Laid-Open No. 6-342636 (U.S. Pat. No. 5,659,329), Japanese Patent Application Laid-Open No. 8-212944, and others. The image display apparatus disclosed in Japanese Patent Application Laid-Open No. 6-342636 is formed by connecting surface-conduction electron emitting devices in a matrix fashion with row wirings and column wirings. When a selection potential is applied to one row wiring, a driving potential is applied to the column wirings. The display of each one line is performed by driving the electron emitting devices with the potential difference between the selection potential and the driving potential (the potential difference being hereinafter referred to as the "driving voltage"). Further, the vertical-direction scanning is performed by sequentially switching selected row wirings at a predetermined scanning frequency, thereby realizing the image display of one frame.

Japanese Patent Application Laid-Open No. 8-212944 discloses a structure that includes a column wiring driving unit and a row wiring driving unit in each of the two regions that are formed by vertically dividing matrix wirings.

A driving technique of performing display by selecting two rows in each field period is also known. By this method, two rows are selected in each field period when interlace driving is performed in such an operation as to display TV signals using a matrix panel. This technique is referred to as the "pseudo-interlace driving" in this specification.

Japanese Patent Application Laid-Open No. 2000-267624 discloses an example of a matrix display apparatus that includes a correlation detecting circuit and a white peak detecting circuit. In this prior art, the white peak detecting circuit detects the luminance level of data supplied to the display panel, as well as the row-direction correlation among the data. When the luminance level is equal to or higher than a predetermined level and there is correlation among the data, scanning is performed on the rows that are determined to have the correlation.

SUMMARY OF THE INVENTION

The object of the present invention is to provide an image display apparatus that can perform excellent image display.

To achieve the above object, the present invention provides an image display apparatus comprising: n of scanning lines, n being an integer of 3 or greater; a scanning circuit that outputs a selection signal for sequentially selecting scanning lines from the n of scanning lines in each transitional selection period, light being to be emitted onto the selected scanning lines; a plurality of display devices that are to form a plurality of pixels that form the plurality of scanning lines; an evaluation circuit that outputs an evaluation value corresponding to the brightness of an image formed by the pixels of each of the plurality of display devices; and a control circuit that changes scanning conditions in the scanning circuit in accordance with the evaluation value, so that the ratio of the total time in term of a unit time of the time when each of the n of scanning lines being selected during the selection periods to the unit time is changed.

Here, the unit time is used as the reference time for evaluating the total time of selection periods in which each of the scanning lines is selected, and a comparative result should be invariably determined with it. For example, one second since the start of displaying one image can be set as the unit time, but the unit time is not limited to that.

Also, the evaluation value corresponding to the brightness of each image may take various forms. Specifically, the average luminance value of the pixels may be used as the evaluation value. In such a case, the evaluation circuit calculates the average luminance value of the pixels as the evaluation value, based on input signals to the evaluation value.

Although the luminance evaluation value that indicates the average luminance value may actually be the average value, it is possible to employ any value as long as it indirectly indicates the average value. The whole sum of luminance is an example of the value that indirectly indicates the average value. For example, the whole sum of luminance or the average value is calculated, and other information such as a contrast control signal may be added to the calculation result. Alternatively, the relationship between the calculation result and the predetermined value, the other conditions such as the contrast control signal are separately evaluated, and the logical sum of the result may be employed. Also, the sum or the average value is obtained by multiplying the luminance of the pixels by a predetermined number. The sum or the average value may be used as the luminance evaluation value that indicates the sum of luminance or the average luminance value.

The luminance evaluation circuit may calculate the whole sum or the average value of weighted luminance, when the whole sum or the average value of the luminance of the plurality of pixels is calculated, based on an input signal.

The luminance evaluation circuit may calculate the whole sum or the average value of all the pixels forming a screen or some of the pixels forming the screen, when the whole sum or the average value of the luminance of the plurality of pixels, based on an input signal.

The evaluation value may be a value that is obtained as a result of displaying an image.

The evaluation value obtained as a result of displaying an image may be a value that is obtained by measuring the brightness of the displayed image. Also, in a case where the display devices include electron emitting devices that emit electrons when voltage is applied, light emitting materials that emit light when the electron beams are emitted from the electron emitting devices, and anode electrodes that lead the electrons emitted from the electron emitting devices to the light emitting materials, the anode current flowing through the anode electrodes may be employed as the evaluation value obtained as a result of displaying the image.

The relationship between the evaluation value and the predetermined value may be used as one of the conditions for changing the scanning conditions. Here, the relationship between the evaluation value and the predetermined value indicates whether the evaluation value is greater or smaller than the predetermined value, or is equal to the predetermined value. However, the condition is not limited to that, as long as the conditions for changing the scanning conditions can be determined by the relationship between the evaluation value and the predetermined value.

More preferably, the control circuit has a function of changing the scanning conditions in the scanning circuit in such a manner that the ratio of the total time of the selection periods to the unit time becomes higher, when detecting that the evaluation value is greater than the predetermined value. During the selection periods, each of the n of scanning lines is selected.

Alternatively, the control circuit may have a function of changing the scanning conditions in the scanning circuit in such a manner that the ratio of the total time of the selection periods to the unit time becomes higher, when detecting that the evaluation value is smaller than the predetermined value. Here, each of the n of scanning lines is selected during the selection periods.

More preferably, the control circuit has a function of changing the scanning conditions in the scanning circuit in such a manner that the ratio of the total time of the selection periods to the unit time changes, in accordance with which range the evaluation value falls within as a result of comparison with a plurality of predetermined values. Here, during the selection periods, each of the n of scanning lines is selected.

More preferably, the control circuit changes at least one of the number of scanning lines to be selected at the same time and the number of scanning lines to be selected two selection period in a row, so that the ratio of the total time of the selection periods to the unit time changes.

More preferably, the image display apparatus further includes a luminance control circuit that operates in such a manner as to reduce a luminance difference caused when the scanning conditions in the scanning circuit are changed.

The present invention also provides an image display apparatus comprising: n of scanning lines, n being an integer of 3 or greater; a scanning circuit that outputs a selection signal for sequentially selecting scanning lines from the n of scanning lines in each transitional selection period, light being to be emitted onto the selected scanning lines; a plurality of display devices that are to form a plurality of pixels that form the plurality of scanning lines; and a control circuit that changes the scanning conditions in the scanning circuit in accordance with an auxiliary signal associated with an input image signal, so that the ratio of the total time of selection periods in terms of a unit time to the unit time is changed, each of the n of scanning lines being selected during the selection periods.

In this image display apparatus, when the auxiliary signal is a predetermined signal indicating that the image to be displayed is a still image, the control circuit sets such scanning conditions that the ratio of the total time of the selection periods to the unit time becomes lower than in a case where the auxiliary signal is a predetermined signal indicating that the image to be displayed is a moving image.

Also, when the auxiliary signal is a predetermined signal indicating that the image to be displayed is an image in a movie, the control circuit sets such scanning conditions that the ratio of the total time of the selection periods to the unit time becomes lower than in a case where the auxiliary signal is a predetermined signal indicating that the image to be displayed is an image in a sports program. Also, the display devices may include electron emitting devices that emit electrons when voltage is applied, light emitting materials that emit light when the electron beams are emitted from the electron emitting devices.

Further, the electron emitting devices may be surface-conduction electron emitting devices.

As described above, the present invention provides an image display apparatus that can display images with high luminance if necessary, and can perform excellent image display.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
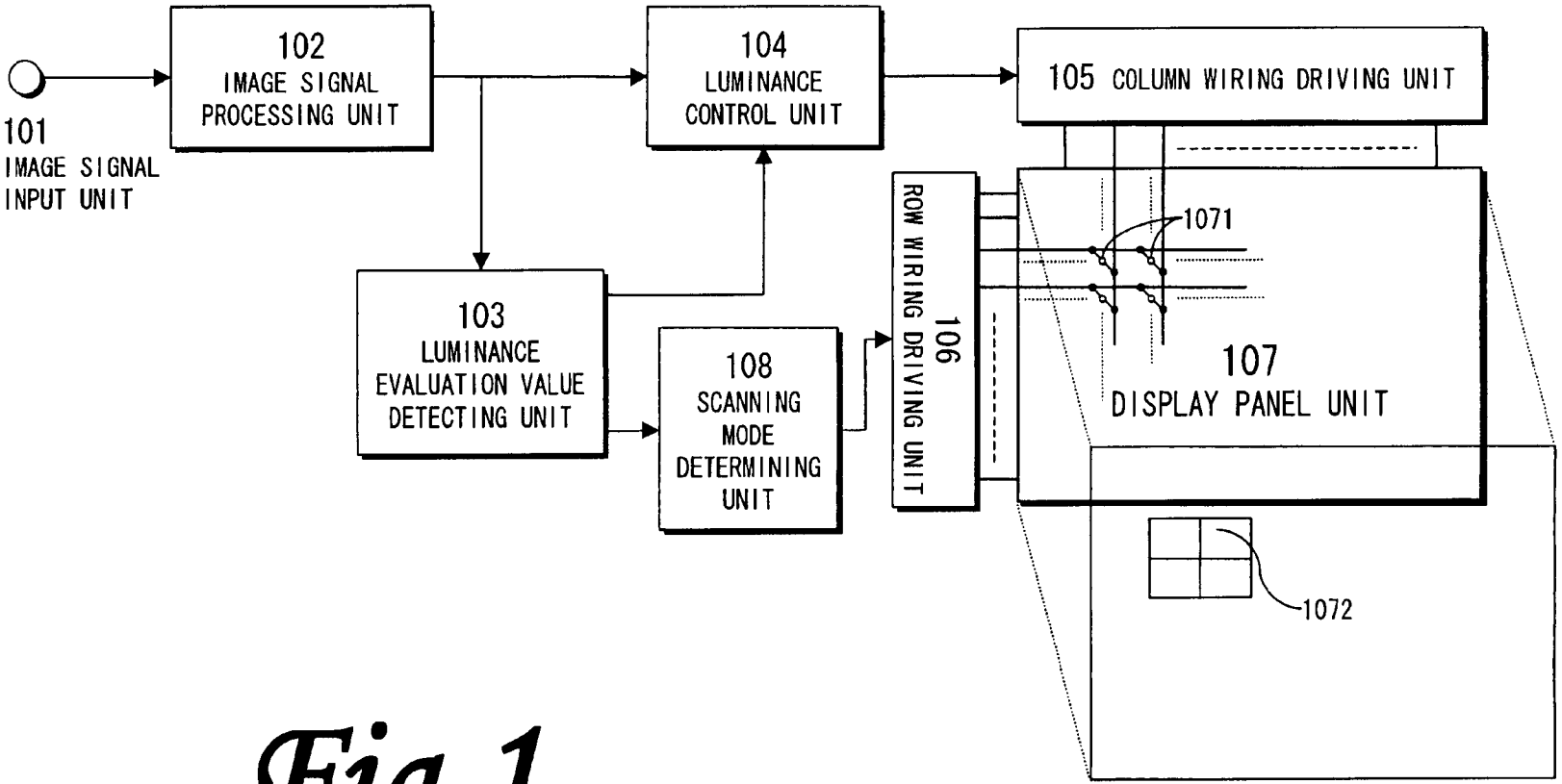
FIG. 1 illustrates the structure of a first embodiment of the present invention.

The following is a description of embodiments of the present invention, with reference to the accompanying drawings. In the all drawings, like components are denoted by like reference numerals. The image display apparatuses and the methods of driving the image display apparatuses in accordance with the embodiments of the present invention are suitable for display apparatus that display image signals (video signals) such as TV signals and image output signals of computers.

In the following embodiments, image display apparatuses each having a surface conduction electron-emitting device are described. However, the present invention can also be suitably applied to image display apparatuses that employ cold cathode electron-emitting devices such as FE devices and MIM devices, EL devices, and liquid crystals.

First Embodiment

FIG. 1 illustrates the structure of an image display apparatus in accordance with a first embodiment.

A display panel unit 107 includes a multi electron beam supply that has surface conduction devices 1071 arranged and connected in a matrix fashion, and a fluorescent surface that receives electron beams from the multi electron beam supply and emits light. A high-voltage bias for accelerating electron beams is applied to the fluorescent surface. The fluorescent surface has light emitting regions 1072 corresponding to the respective surface conduction electron-emitting devices. In this embodiment, the display device is formed with the surface conduction devices 1071 and the light emitting regions 1072 corresponding to the respective surface conduction devices 1071. The substrate on which the surface conduction devices 1071 are mounted and the substrate on which the light emitting regions 1072 are mounted are arranged so that electrons emitted from the surface conduction devices 1071 are incident upon the light emitting region 1071 corresponding to the emitted electrons. In FIG. 1, however, the substrates are shifted from each other, for ease of explanation. Japanese Unexamined Patent Publication No. 6-342636 discloses the method of manufacturing the display panel unit 107 in detail, and therefore, explanation of it is not repeated here.

As disclosed in Japanese Unexamined Patent Publication No. 6-342636, there are several methods for controlling the emission luminance and tone of a display panel that includes surface conduction devices. In the first embodiment that embodies one of those methods, a column wiring driving unit 105 applies a voltage pulse having a pulse width corresponding to input luminance data that specifies the emission light quantity of each pixel to the column wirings, and a row wiring driving unit 106 applies a selective voltage pulse to the lines for causing light emission and a non-selective voltage to non-selected lines. In this embodiment, image display is performed by sequentially scanning the selected rows in accordance with the so-called pulse width modulation/line sequential driving method. In the case of simple pulse width modulation, the luminance indicated by a device that is emitting light is uniform during the light emission period of the device. However, the integrated value of the luminance over a long period of time (more specifically, a one horizontal scanning period) is modulated. Accordingly, the integrated value of luminance detected when the pulse width is small is smaller than the integrated value of luminance detected when the pulse width is large. Therefore, the luminance appears to be modulated to the eye of a user, even if the pulse width is being modulated. In the present invention, luminance is regarded as modulated even if the pulse width is modulated. Here, the column wiring driving unit 105 that supplies a modulation signal to the column wirings as the modulation wirings is equivalent to a modulation circuit, while the row wiring driving unit 106 that supplies a selection signal to the row wirings as the scanning wirings is equivalent to a scanning circuit. Write scanning is performed on the scanning wirings, and a modulation signal is to be written on the device connected to a selected scanning wiring in a write scanning operation. In this embodiment, the device that is connected to a scanning wiring selected for a write scanning operation starts emitting light substantially at the same time as the write, and stops the light emission when the selection for the write is finished. Therefore, in this embodiment, the scanning lines corresponding to the scanning wirings on which write scanning is to be performed are formed with the scanning lines onto which light is to be emitted. Accordingly, the row wiring driving unit 106 that is to perform write scanning also serves as the scanning circuit that is to select the scanning lines onto which light is to be emitted.

The structure of this embodiment is also equipped with a power supply for determining the potential of the output voltage pulse of the column wiring driving unit 105, and a power supply for determining the potential of the output selective voltage pulse of the row wiring driving unit 106. These power supply output values can be controlled.

The row wiring driving unit 106 includes the same number of SW units as the number of the panel row wirings, and a scanning signal generating unit that supplies a scanning signal indicating "selection/non-selection" to the SW units. When selection is made, the row wiring driving unit 106 supplies a scanning voltage pulse to the row wirings of the display panel unit 107. When selection is not made, the row wiring driving unit 106 supplies a non-selective bias voltage to the row wirings of the display panel unit 107.

An image signal input unit 101 is an input unit that receives a video signal input from the outside. Although not shown, in a case where an input video signal is compressed from an original signal so as to transmit the video signal through a restricted transmission band, the image signal input unit 101 includes a decoding unit that expands the compressed signal and decodes the signal to the original signal.

The video signal input to the image signal input unit 101 is transmitted to an image signal processing unit 102.

In the image signal processing unit 102, the image signal transmitted from the image signal input unit 101 is subjected to sampling so as to conform to the number of devices and the pixel structure of the display panel unit 107, and the luminance data equivalent to the electron beam emission amount requesting value data of each pixel of the display panel unit 107 is generated from the input image signal.

As for the number of vertical lines, in a case where the number of valid display scanning lines for input video signals is different from the number of display row lines of the display panel unit 107, an expanding and contracting operation such as scanning line interpolation is performed to output a driving luminance signal that conforms to the number of display row lines of the display panel unit 107.

The generated luminance data is transmitted to the column wiring driving unit 105 in such a manner that the luminance data stream of one row is transmitted within one line scanning period, so that the luminance data can be displayed in synchronization with the selected scanning of the row wirings to be displayed. Since display apparatuses with CRTs are employed in many cases, $\gamma$ correction is often performed on each image signal, with the $\gamma$ characteristics of the CRTs being taken into consideration. Therefore, in the case where a display panel having emission luminance that is substantially proportional to the electron beam emission requesting value data is to be operated, so-called reverse $\gamma$ correction is also performed in the image signal processing unit 102 so as to cancel the $\gamma$ correction that has been performed in advance.

The image signal processing unit 102 separates synchronization signals included in the input image signals from image signals, and, based on the synchronization signals, generates and supplies clock signals and timing signals that are necessary for each component to operate.

A luminance evaluation value detecting unit 103 that serves as a luminance evaluation circuit and a control circuit receives the luminance data equivalent to the electron beam emission amount requesting value data of each pixel of the display panel unit 107 from the image signal processing unit 102, and calculates the luminance evaluation value that indicates an estimate of the emission luminance state of the display panel unit 107. The calculation of the luminance evaluation value may be performed using the luminance signal obtained prior to the division into signals corresponding to RGB, or the signal obtained after the division into signals corresponding to RGB may be used as a signal with the value corresponding to the luminance.

The luminance evaluation value is compared with a predetermined reference value, so as to output a control signal for switching scanning modes depending on the result to a scanning mode determining unit 108 and the luminance control unit 104. A signal that has correlation with the calculated luminance evaluation value is also output to the luminance control unit 104. The luminance evaluation value should be a value indicating the brightness of the screen to the eye of users. Therefore, to prepare for the evaluation value calculation performed by the luminance evaluation value detecting unit 103, all the luminance data obtained from the image signal processing unit 102 during one frame period are added to obtain the whole sum in this first embodiment. Here, the ratio of the whole sum to the one-frame cumulative total value obtained in the case where all the luminance data show the maximum values (a display area rate) is set as the luminance evaluation value.

The luminance control unit 104 changes the luminance data equivalent to the electron beam emission amount requesting value data of each pixel of the display panel unit 107 in accordance with the signal having correlation with the luminance evaluation value calculated by the luminance evaluation value detecting unit 103. The luminance data is obtained from the image signal processing unit 102. The luminance control unit 104 is equivalent to the luminance control circuit in the present invention.

The scanning mode determining unit 108, which serves as a control circuit to change scanning conditions, receives a control signal from the luminance evaluation value detecting unit 103, and outputs a signal for changing the row wiring scanning methods of the display panel unit 107 to the row wiring driving unit 106.

Figure 3:
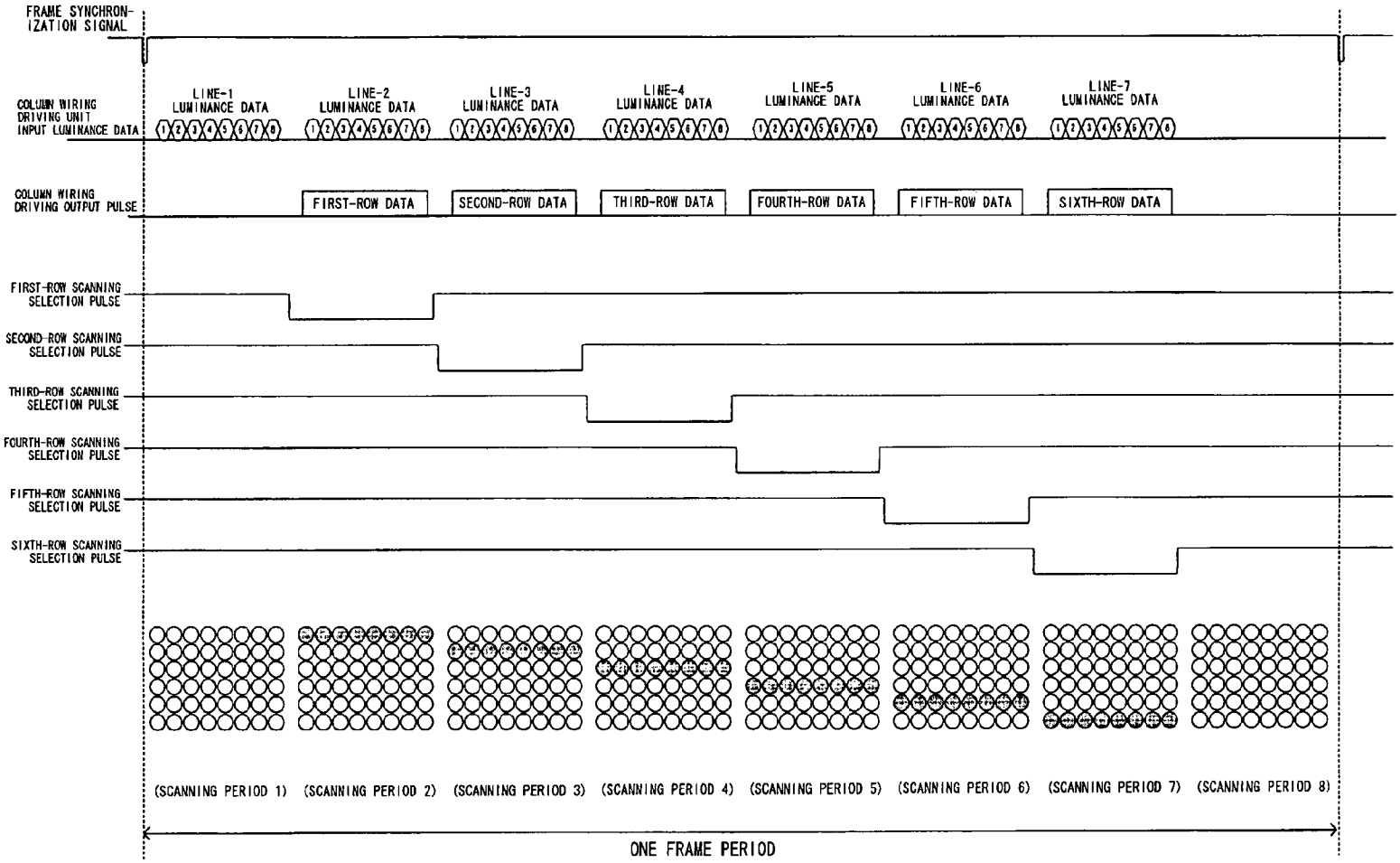
FIG. 3 illustrates display examples in the first row scanning mode in the first embodiment of the present invention.
Figure 4:
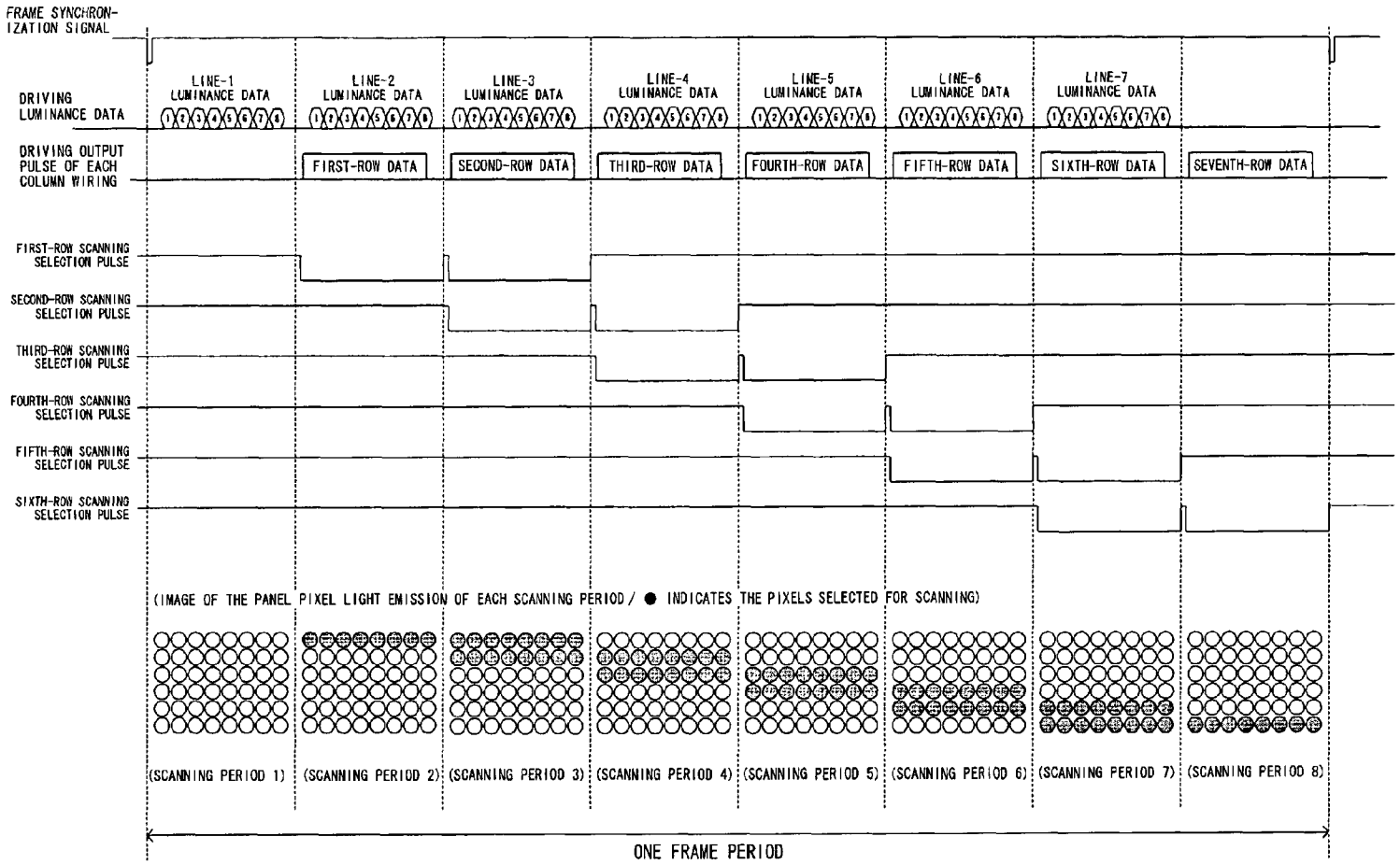
FIG. 4 illustrates display examples in the second row scanning mode in the first embodiment of the present invention.

FIGS. 3 and 4 illustrate display examples in first and second row scanning modes in the first embodiment. For ease of understanding, each examples is shown as a 8×6 matrix or small panel in which the display devices that form the pixels constituting part of an image are arranged in 8 columns and 6 rows.

FIG. 3 illustrates scanning operations in the first scanning mode in which the row wiring of one row is selected in a scanning period, and the row wiring of the next neighboring row wiring is selected in the next scanning period. The luminance decreasing characteristics with an increase in display area during the scanning operation are shown by the curve indicated by the dashed line in FIG. 2.

Such a decrease in the display luminance is caused when the driving current of the surface conduction devices forming each pixel is flown from each row wiring to the selected row wiring(s), and is then flown into the row wiring driving unit. At this point, a potential gradient is caused on the scanning wirings due to the electric resistance of the row wirings and the selective current, resulting in a decrease in driving voltage to be applied to the electron emission devices. The decrease in luminance varies with the current flowing on the row wirings or the subject display image. Accordingly, a decrease in luminance is hardly caused in the case where only the small-area portions of the display devices emit light, because the potential generated on the row wirings is small. However, the decrease in luminance becomes greater as the emission area of each display device (or the length of the light emitting unit in the row wiring direction) becomes larger.

FIG. 4 illustrates scanning operations in the second scanning mode in which the row wirings of two rows are simultaneously selected in one scanning period, and the row wiring of one of the two rows is again selected in the next scanning period. The luminance decreasing characteristics with the display area in the same scanning mode are shown by the curve indicated by the dotted line in FIG. 2.

Figure 2:
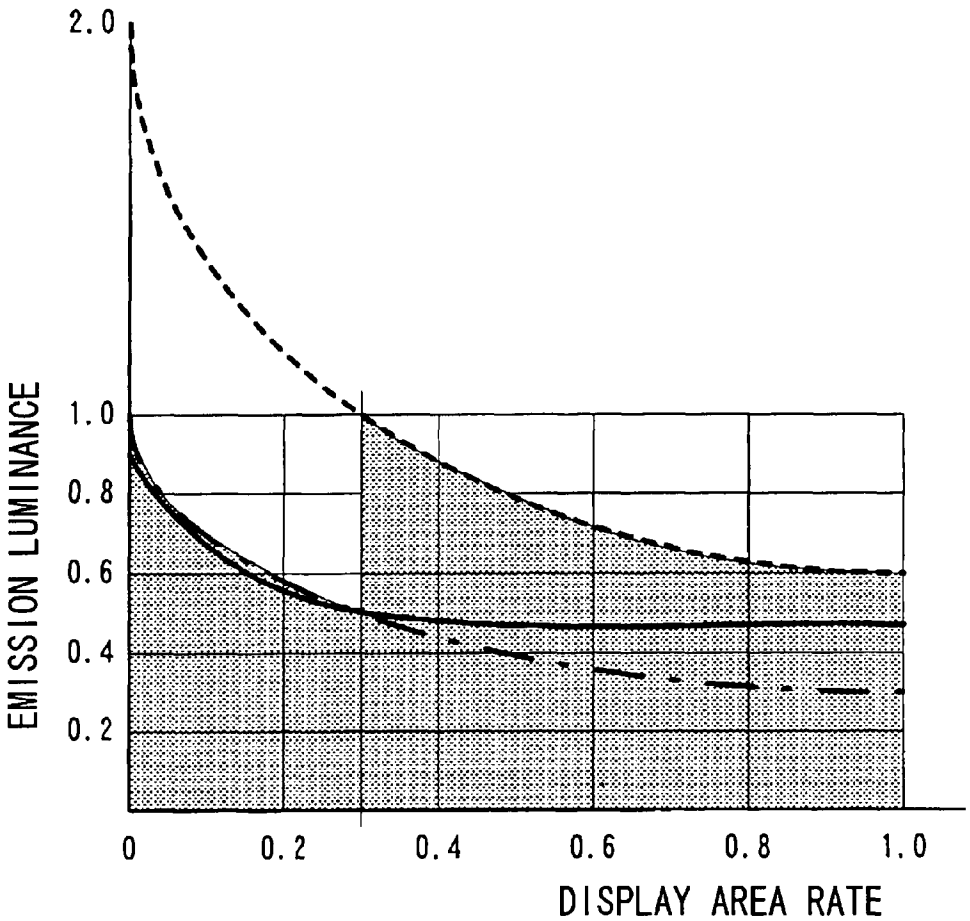
FIG. 2 illustrates the luminance characteristics that are improved with the display area rate in the first embodiment of the present invention.

As shown in FIG. 2, in the second scanning mode illustrated in FIG. 4, the total time during which a selection signal is supplied to each of the scanning wiring becomes twice as long, and accordingly, it is possible to obtain luminance twice as high as the luminance obtained in the first scanning mode illustrated in FIG. 3.

Figure 5:
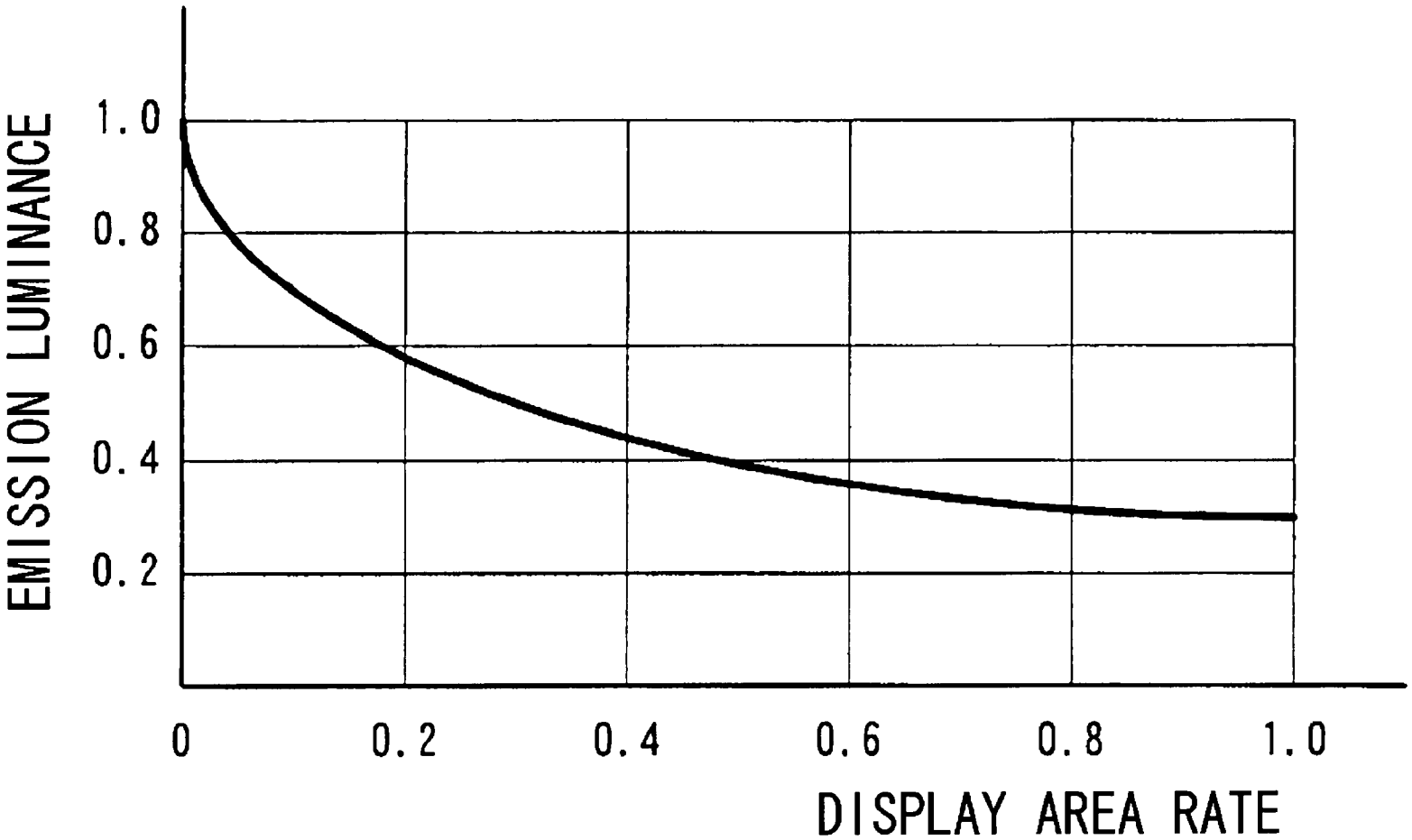
FIG. 5 illustrates the luminance decreasing characteristics with the display area rate in the prior art.

In the first embodiment, a control operation is performed so that the row wiring scanning modes of the display panel unit 107 are switched at the display area rate of 0.3 as shown in FIG. 2. More specifically, if the luminance evaluation value detecting unit 103 determines that the luminance evaluation value that indicates an estimate of the emission luminance state of the display panel unit 107 is equivalent to a display area rate of 0.3 or lower, the scanning mode determining unit 108 performs such a control operation that a scanning operation is performed in the first scanning mode illustrated in FIG. 3. If the luminance evaluation value detecting unit 103 determines that the luminance evaluation value is equivalent to a display area rate of 0.3 or higher, the scanning mode determining unit 108 performs such a control operation that a scanning operation is performed in the second scanning mode illustrated in FIG. 4. Here, the luminance evaluation value detecting unit 103 is equivalent to the evaluation circuit. By performing a control operation in this manner, the shadowed region in FIG. 2 becomes the light emission region of the image display apparatus of the present invention. Compared with the characteristics in the prior art shown in FIG. 5, the luminance characteristics are dramatically improved in the large-area portion. Also, in accordance with the present invention, the luminance characteristics can be improved without increasing the number of driving circuits or complicating the driving circuit structure. Thus, a cost increase can be prevented.

As can be seen from the shadowed region in FIG. 2, in the case where scanning modes are switched at the display area rate threshold of 0.3, there is a luminance difference between before and after the threshold value of 0.3. So as to reduce the luminance difference, the first embodiment employs the luminance control unit 104. More specifically, the luminance evaluation value detecting unit 103 outputs a signal having correlation with a scanning mode switching signal and the calculated luminance evaluation value to the luminance control unit 104, so that the luminance data equivalent to the electron beam emission amount requesting value data of each pixel of the display panel unit 107 from the image signal processing unit 102 can be adjusted to reduce the luminance difference in the luminance control unit 104 between before and after the scanning mode switching.

The adjustment is performed so that the luminance decreasing characteristics that vary with the display area become the same as the characteristics indicated by the solid-line curve in FIG. 2.

Although the luminance data is varied to reduce the luminance difference in the above description, the technique of reducing the luminance difference between before and after scanning mode switching is not limited to that. The present invention may be applied to any control operation that can change the display luminance. More specifically, Japanese Unexamined Patent Publication No. 6-342636 discloses a technique of varying the display luminance with voltage and driving current to be applied to electron emission devices, or a high-pressure voltage that accelerates electron beams to be emitted. This technique can be utilized for performing a control operation for reducing the luminance difference.

The structure of this embodiment may further include a means for suppressing the variation in the vertical resolution characteristics that is caused when scanning modes are switched. More specifically, a vertical-direction outline emphasizing circuit is employed to vary the outline emphasizing amount when the scanning modes are switched. Referring back to FIG. 2, if the luminance evaluation value is greater than the display area rate of 0.3, the row wirings of two rows are selected at the same time during one scanning period, and a scanning operation is performed so that the row wiring of one row is again selected in the next scanning period. At this point, the vertical resolution characteristics deteriorate due to the simultaneous selection of the two rows and the repetitive selection of the one row. Therefore, the operations of the outline emphasizing circuit are switched so that the vertical-direction outline emphasizing amount can be increased. Further, the outline emphasizing amount in the circuit may be varied with the luminance evaluation value, so that the operations before and after the scanning mode switching can be smoothly performed without intermission.

Figure 6:
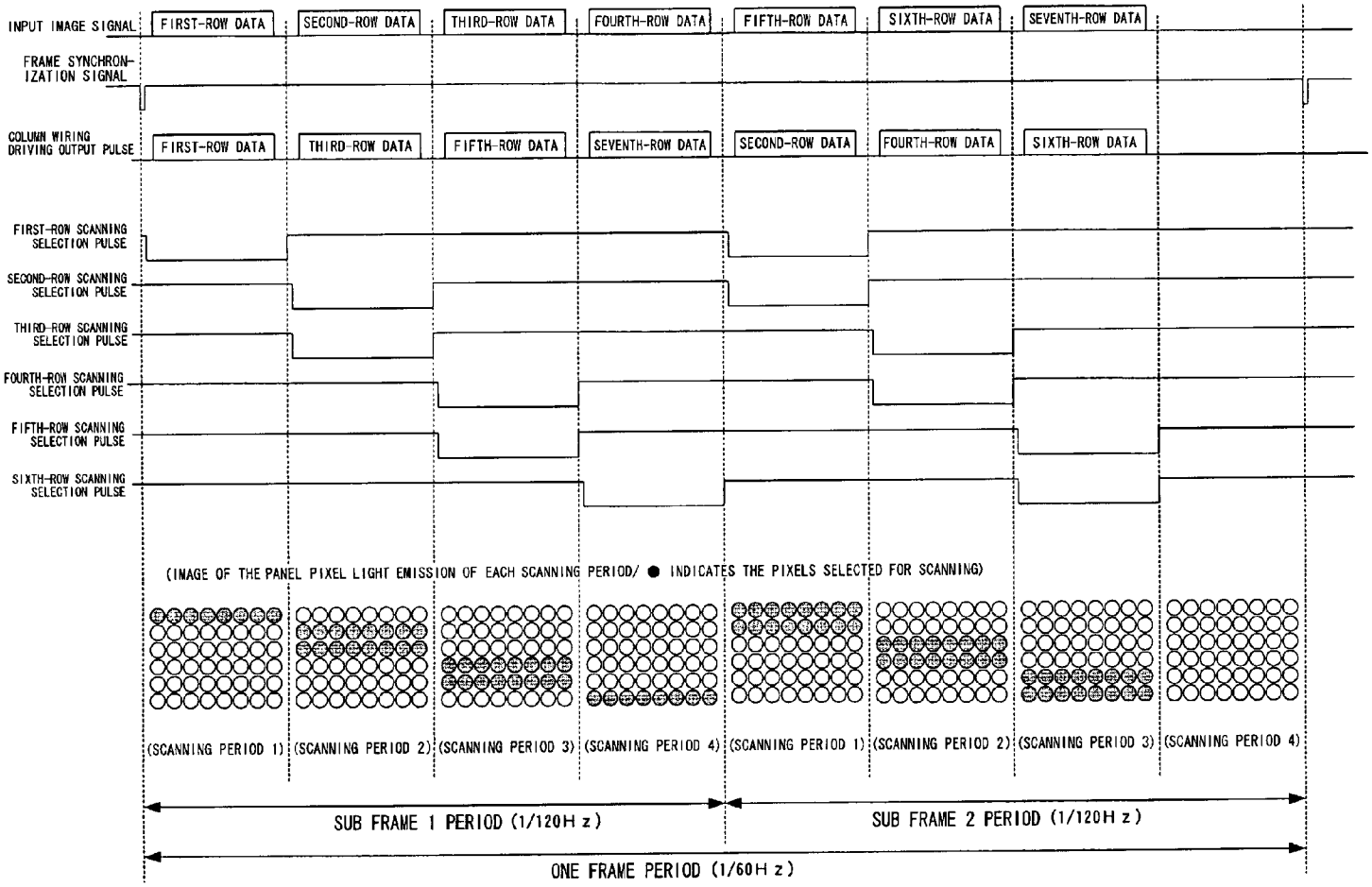
FIG. 6 illustrates display examples in the first row scanning mode in the first embodiment of the present invention.

The scanning modes employed in this embodiment shown in FIGS. 3 and 4 are described above. However, it is also possible to choose a scanning mode shown in FIG. 6, for example. More specifically, one frame period (1/60 sec, for example) is divided into two sub frame periods (1/120 sec). In the first sub frame period, an odd-number (2N+1, N=0, 1, . . . ) row is selected together with a neighboring even-number (2N) row in each scanning period, and the image data of each odd-number row is displayed. Meanwhile, in the second sub frame period, an even-number (2N) row is selected together with a neighboring odd-number (2N−1) row in each scanning period, and the image data of each even-number row is displayed. This technique is preferable especially when an interlaced signal is input.

As an example of the method of switching the scanning modes shown in FIGS. 3 through 6, the scanning signal generation of each row should be performed in the row wiring driving unit 106 in the following manner.

Figure 9:
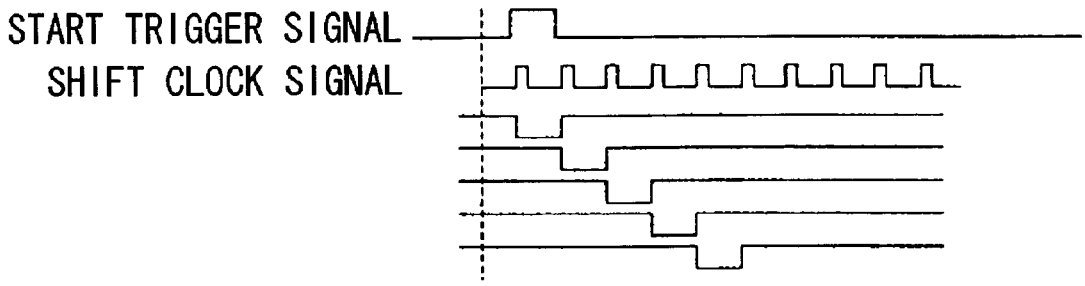
FIG. 9 illustrates an example of the scanning timing signal for realizing the row scanning mode switching in the first embodiment of the present invention.
Figure 9:
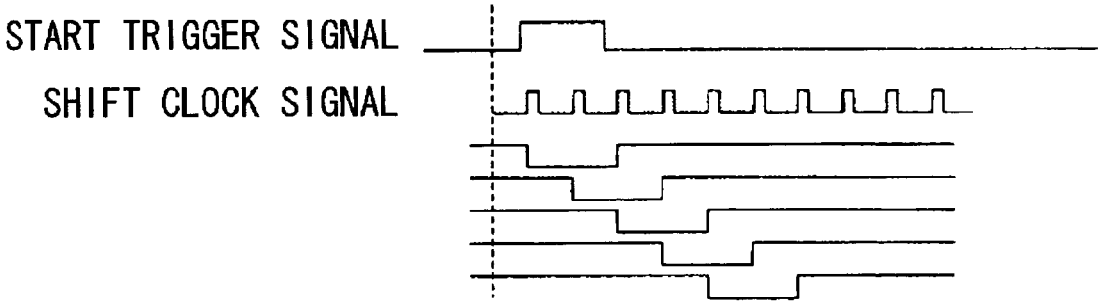
Figure 9:
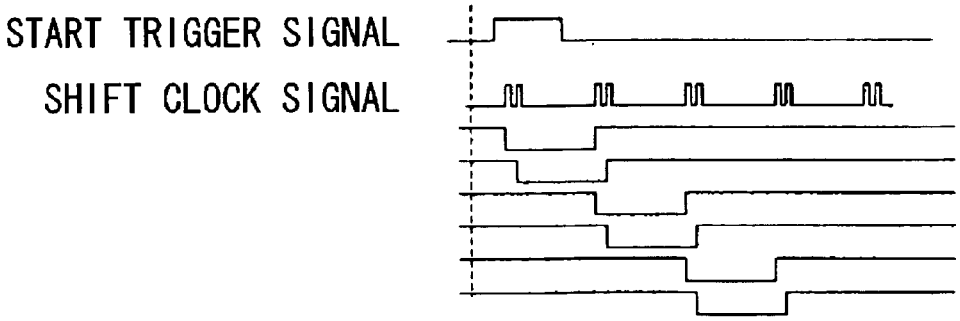

The same number of shift registers as the row wirings are prepared, and a start trigger signal for starting a row scanning operation and a shift clock signal for sequentially switching selection lines are supplied to the shift registers. The phase relation between the start trigger signal and the shift clock signal is changed as shown in FIG. 9, so that the scanning modes shown in FIGS. 3 through 6 can be realized.

The conditions of scanning for different total durations may include the number of scanning wirings to which a selection signal is applied in one selection period, the number of scanning wirings to which a selection signal is applied in two selection periods in a row, or the above numbers are different from each other.

The luminance evaluation value is not limited to the above described value, and there should be many variations.

Particularly, in a case where a decrease in luminance due to a voltage drop caused by an increase in current flowing on the scanning wirings is to be improved, the line cumulative total value of the luminance data is obtained in each line scanning period, so as to calculate the luminance evaluation value. This is because the adverse influence of a voltage drop is especially conspicuous when an object that is long in the scanning wiring direction is to be displayed with high luminance. Based on the line cumulative total value, a voltage drop to be caused in the corresponding line is estimated, and the line cumulative total value weighted with the estimate value is added up for the number of valid scanning lines. Thus, the luminance evaluation value of one frame can be obtained.

Taking into account that an object to be displayed is often located in the center of the screen, it is possible to use the whole sum or the average luminance value of pixels. In such a case, multiplication is performed with the weighting factor in the center portion and the peripheral portion. It is also possible to use the whole sum or the average luminance value of some of the pixels that form the subject image, instead of the whole sum or the average luminance value of all the pixels.

The luminance evaluation value may be a calculation result or a value obtained by adding a contrast control signal to the calculation result. Alternatively, whether the calculation result is greater than a predetermined value is determined, and other conditions including a contrast control signal are evaluated separately. In such a case, the logical sum of the results may be used as the luminance evaluation value.

In the first embodiment, the scanning modes are switched so that high luminance is obtained when the luminance evaluation value is greater than 0.3, and emphasis can be put on resolution when the luminance evaluation value is equal to or smaller than 0.3. This is because an image with a high luminance evaluation value tends to have a large high-luminance display area. This tendency was discovered based on the result of an evaluation test conducted on the luminance evaluation value and the image quality that were obtained when TV moving image signals sampled at random by the inventor(s) were used as input image signals. Compared with an image with a low luminance evaluation value, an image containing a number of large high-luminance areas has only a small variation in luminance in the vertical direction and is less likely to have a high-resolution signal. Therefore, a decrease in resolution due to multi-row simultaneous scanning does not adversely affect the operation. Thus, even when progressive display is performed, a decrease in vertical resolution can be prevented.

However, it should be understood that the luminance evaluation value of 0.3 is merely an example, and the same effects can be achieved with a different value from the above.

As described above, in the first embodiment, the average value of the luminance of the pixels is calculated based on input signals. According to the luminance evaluation value based on the calculation result, the scanning conditions employed in the scanning circuit are changed so that the total time of the periods during which a selection signal is applied to each of n of scanning wirings in the unit time are changed. In this manner, more preferable image display can be performed.

Second Embodiment

In the first embodiment, the luminance evaluation value is obtained by calculating the whole sum of the luminance data of one frame period. In the case where display control is performed based on the luminance evaluation value of one frame period, the evaluation value calculation requires the one frame. Therefore, a frame buffer is prepared to perform a 1-frame delaying operation, so that the frame to be displayed is synchronized with the evaluation value calculating frame.

However, input image signals characteristically include image signals with high correlation between two consecutive frames. Accordingly, it is also possible to perform display control using the evaluation value of the previous frame, and the frame buffer can be removed to reduce the production costs of the display devices.

In a case where an image signal with low correlation with the image signals of the adjacent frames, though it is rare, the display quality might become poor if such an image is input that the luminance evaluation values of the frame signals of consecutive frames alternately become greater and smaller than a predetermined threshold value.

Therefore, the unit time for calculating the evaluation value is made longer than one frame period in the second embodiment. Here, the unit time is set as one second, as it is considered that the human eye requires one second to several seconds to adjust to a change in the amount of stimulation. It should be understood that the unit time is not limited to one second and may be varied as desired.

To calculate the evaluation value in the unit time of one second, the whole sum of the luminance data in one frame is calculated as in the first embodiment, and the calculation result is stored in a memory unit provided in the luminance evaluation value detecting unit 103. The frame evaluation values that are equivalent in number to the refresh frequency of the input image signal are averaged to obtain the luminance evaluation value in the unit time. For example, in a case where the input image signals exhibit a refresh rate of 60 Hz, sixty frame evaluation values are calculated and then averaged.

By the above technique of calculating the luminance evaluation value, the average value of the luminance of the pixels is calculated based on input signals. According to the luminance evaluation value based on the calculation result, the scanning conditions employed in the scanning circuit are changed so that the total time of the periods during which a selection signal is applied to each of the n of scanning wirings in the unit time are changed. In this manner, more preferable image display can be performed.

Third Embodiment

Although the luminance evaluation value is obtained from the luminance data in the second embodiment, there is another method of obtaining the evaluation value.

In the structure shown in FIG. 1, the display panel unit 107 includes a multi electron beam supply that has surface-conduction devices arranged in a matrix, and a fluorescent surface that emits light when irradiated with the electron beams emitted from the multi electron beam supply, although not shown in FIG. 1. In this embodiment, a high-voltage power supply is separately prepared, and a high-pressure voltage bias for accelerating the electron beams is applied to the fluorescent surface.

A detecting unit that detects the average value of the current supplied from the high-voltage power supply to the display panel unit 107 is also prepared, and the detected value is regarded as the luminance evaluation obtained as a result of displaying the subject image. Thus, the same control operation as in the second embodiment can be performed.

According to the evaluation value obtained as a result of displaying the subject image based on input signals, the scanning conditions employed in the scanning circuit are changed so that the total time of the periods during which a selection signal is applied to each of the n of scanning wirings in the unit time are changed. In this manner, more preferable image display can be performed.

Fourth Embodiment

In each of the first through third embodiments, the evaluation value indicating the brightness of the subject image is detected, and is compared with a predetermined threshold value. If the evaluation value is greater than the threshold value, scanning modes are switched so that the luminance becomes higher. However, the present invention is not limited to that operation, but it is also possible to switch scanning modes so that the luminance is made higher when the evaluation value is smaller than the threshold value.

Figure 7:
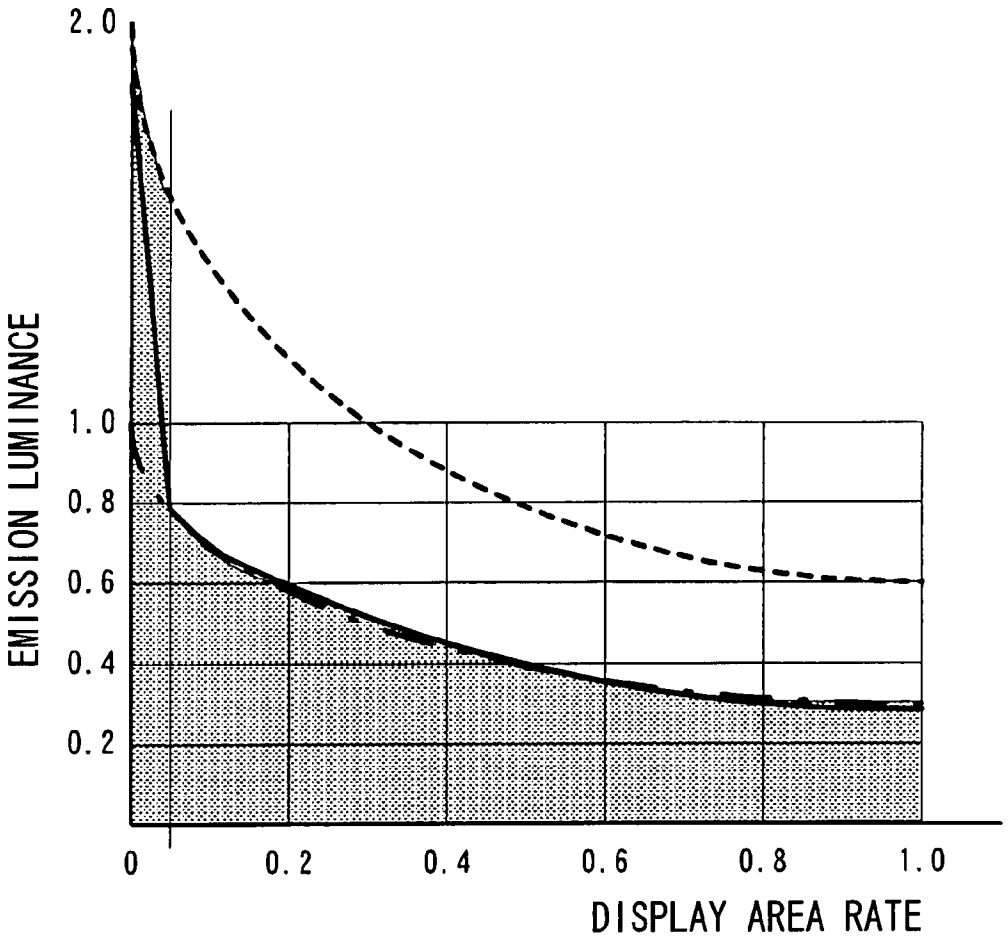
FIG. 7 illustrates the luminance characteristics that are improved with the display area rate in a fourth embodiment of the present invention.

FIG. 7 shows the emission luminance characteristics that are obtained when scanning modes are switched in the above described manner. The shadowed portion in FIG. 7 indicates the light emission region of the image display apparatus of this embodiment. Here, scanning modes are switched with a threshold value of 0.05.

As can be seen from the shadowed region in FIG. 7, in the case where scanning modes are switched with the threshold value of 0.05, there is a luminance difference around the threshold value. So as to reduce the luminance difference, the luminance evaluation value detecting unit 103 outputs a signal having correlation with a scanning mode switching signal and the calculated luminance evaluation value to the luminance control unit 104, so that the luminance data equivalent to the electron beam emission amount requesting value data of each pixel of the display panel unit 107 can be adjusted to reduce the luminance difference before and after the scanning mode switching, as in the first embodiment.

The adjustment is performed so that the luminance decreasing characteristics that vary with the display area become the same as the characteristics indicated by the solid-line curve in FIG. 7.

As described above, scanning modes are switched so as to obtain high luminance when the luminance evaluation value is small in the fourth embodiment. In this manner, the peak luminance of the small-area portion can be made higher, without an increase in power consumption in the entire display apparatus.

Also, in the fourth embodiment, excellent image display can be performed even in a case where only a specific region of the small-area portions in an image is to be displayed with high luminance. For example, when an image of a star-studded night sky is to be displayed, higher luminance is desired to display the twinkle of the stars. In this embodiment, such an image can be displayed as desired.

As described above, according to the evaluation value obtained from the whole sum of the luminance of pixels based on input signals, the scanning conditions employed in the scanning circuit are changed so that the total time of the periods during which a selection signal is applied to each of the n of scanning wirings in the unit time are changed. In this manner, more preferable image display can be performed.

Fifth Embodiment

Figure 8:
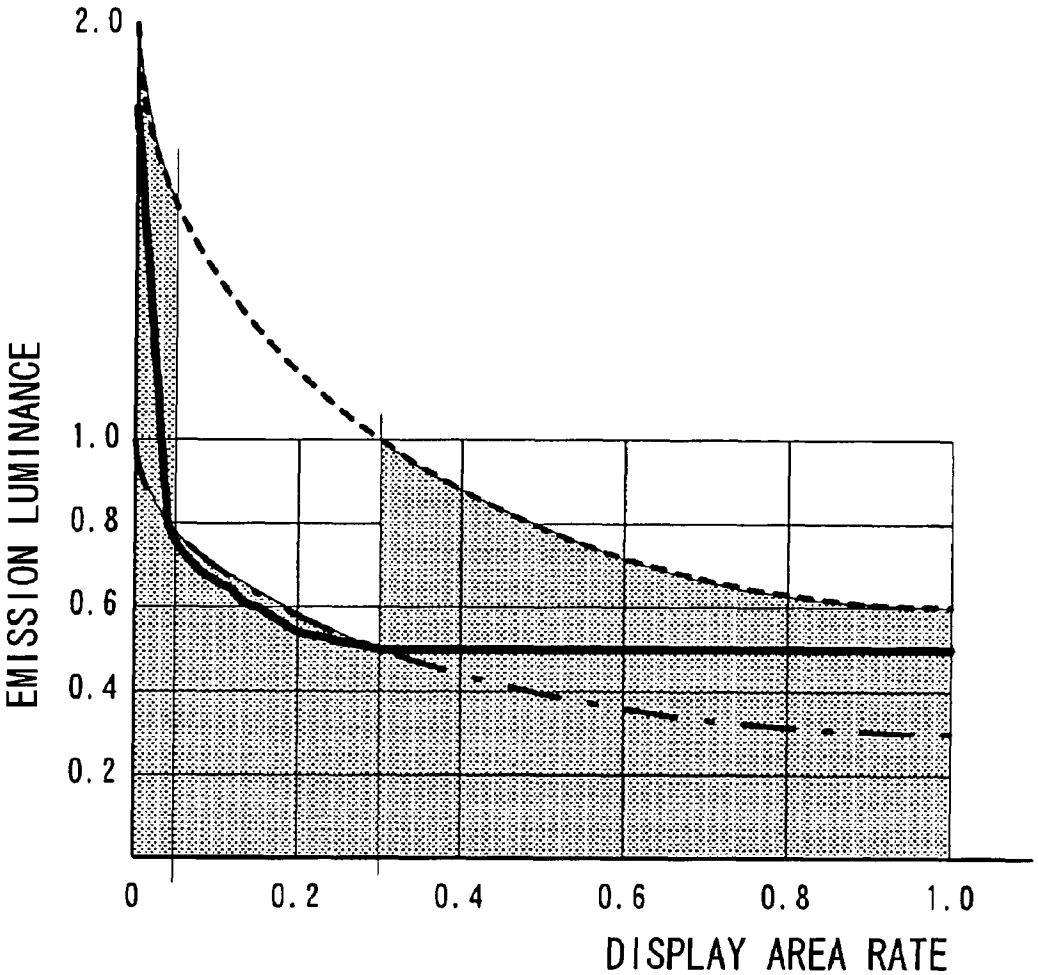
FIG. 8 illustrates the luminance characteristics that are improved with the display area rate in a fifth embodiment of the present invention.

FIG. 8 illustrates the emission luminance characteristics in accordance with a fifth embodiment of the present invention. The shadowed portion in FIG. 8 indicates the light emission region of the image display apparatus of the fifth embodiment. Here, scanning modes are switched with the threshold values of 0.05 and 0.3. More specifically, scanning modes are switched so as to obtain higher luminance, when the luminance evaluation value is smaller than 0.05 or greater than 0.3.

By switching the scanning modes in the above manner, display is performed, with emphasis being put on the resolution in the case of high-luminance display or medium-luminance display for small-area portions and large-area portions. Thus, an excellent display apparatus can be provided.

As can be seen from the shadowed region in FIG. 8, in the case where scanning modes are switched with the threshold values of 0.05 and 0.3, there is a luminance difference around each of the threshold values. So as to reduce the luminance differences, the luminance evaluation value detecting unit 103 outputs a signal having correlation with a scanning mode switching signal and the calculated luminance evaluation value to the luminance control unit 104, so that the luminance data equivalent to the electron beam emission amount requesting value data of each pixel of the display panel unit 107 can be adjusted to reduce the luminance difference before and after the scanning mode switching, as in the first embodiment.

The adjustment is performed so that the luminance decreasing characteristics that vary with the display area become the same as the characteristics indicated by the solid-line curve in FIG. 8.

As described above, according to the luminance evaluation value obtained from the whole sum of the luminance of pixels based on input signals, the scanning conditions employed in the scanning circuit are changed so that the total time of the periods during which a selection signal is applied to each of the n of scanning wirings in the unit time are changed. In this manner, more preferable image display can be performed.

Sixth Embodiment

In the above embodiments, the scanning conditions are changed based on the value corresponding to the brightness of the subject image.

In this embodiment, on the other hand, the scanning conditions are changed according to an auxiliary signal that is associated with an image to be displayed.

Figure 10:
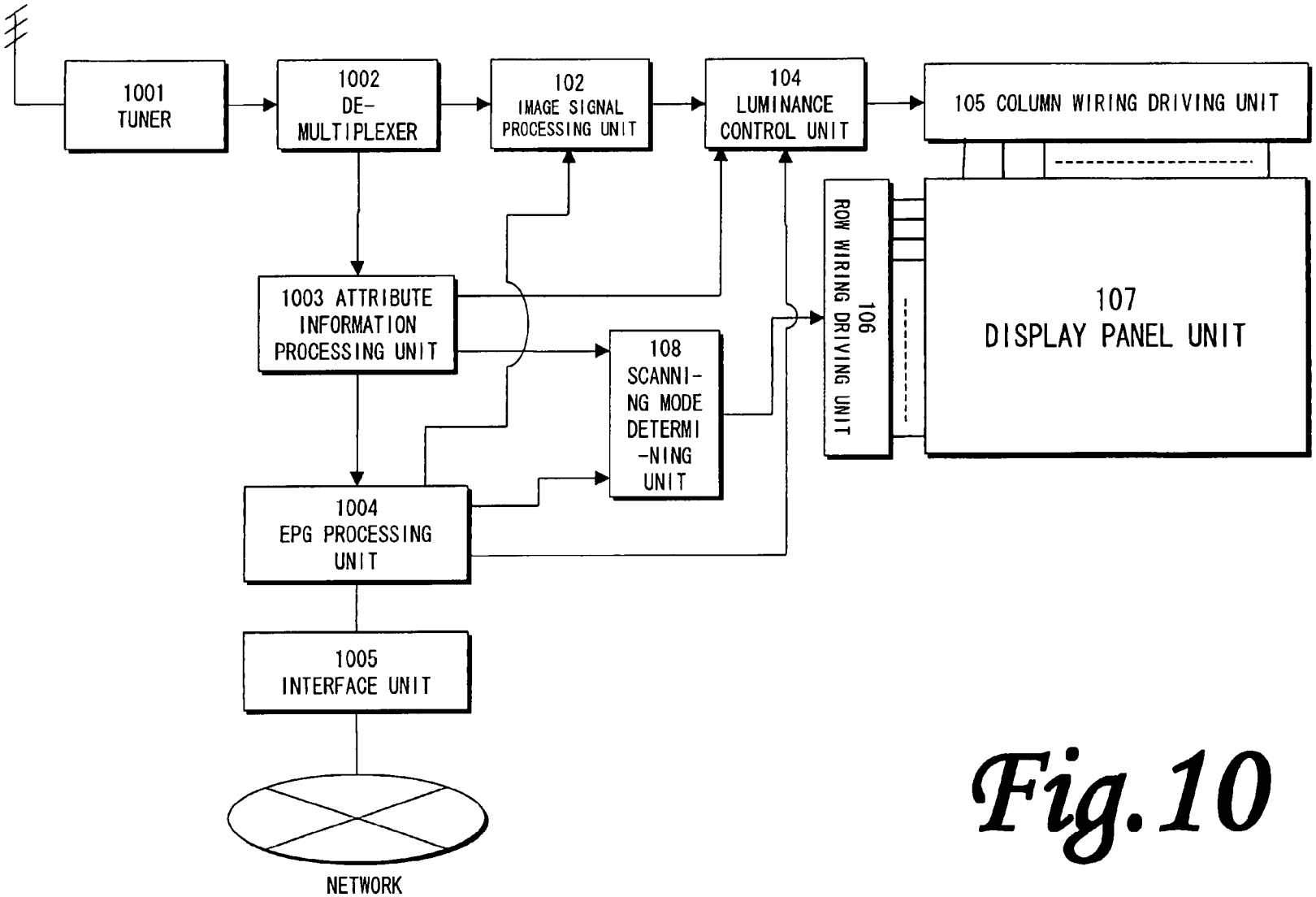
FIG. 10 illustrates the structure of a sixth embodiment of the present invention.

For example, in digital broadcasting, image signals for reproducing a program are combined with information that indicates the attribute of the program. The attribute information contains information as to the genre of the program, the cast members of the program, and others. In the sixth embodiment, the scanning conditions are controlled using the information. FIG. 10 illustrates the structure of the image display apparatus in accordance with the sixth embodiment.

As shown in FIG. 10, the image display apparatus forms a television set, having a tuner 1001 that receives broadcasting television signals, a de-multiplexer 1002 that extracts image signals and attribute information from the television signals received by the tuner 1001, and an attribute information processing unit 1003 that processes the attribute information. The image display apparatus also includes an EPG processing unit 1004 that performs processing to display an electronic program listing. The information extracted by the de-multiplexer 1002 can be used as the information for displaying an electronic program listing. Also, information obtained from the Internet via an interface unit 1005 can be used as the information for displaying an electronic program listing.

The other aspects of the sixth embodiment are the same as the corresponding aspects of the first embodiment, except that the image signal processing unit 102 performs an operation to display an electronic program listing based on signals transmitted from the EPG processing unit 1004, the scanning mode determining unit 108 sets scanning conditions based on signals transmitted from the attribute information processing unit 1003 or the EPG processing unit 1004, and the luminance control unit 104 performs luminance control based on signals from the attribute information processing unit 1003 or the EPG processing unit 1004.

In the sixth embodiment, when the attribute information processing unit 1003 detects that the program to be displayed is a movie, the scanning conditions are set so that display can be performed with higher resolution than in a case where a news or sports program is to be displayed.

More specifically, for a program such as a news or sports program that requires a bright screen, the scanning conditions shown in FIG. 4 are employed. For a program such as a movie that is preferred with high resolution, the scanning conditions shown in FIG. 3 are employed. By doing so, display can be performed according to the attribute of each program. The information indicating the attribute of a program is not necessarily carried on an auxiliary signal that is transmitted together with a television broadcasting signal. For example, according to electronic program information obtained from the Internet, the EPG processing unit 1004 detects from the electronic program information that the image to be displayed is an image in a movie, and suitable scanning conditions are then set.

In this embodiment, the scanning conditions are controlled, with the genre of each program being regarded as the attribute of each program. However, it is also possible to employ a structure in which the transmitter of a program provides the information indicating whether the program requires brightness or resolution, and operating conditions are set according to the information.

An auxiliary signal is not necessarily set for each program, but may be set for each scene or frame. In such a case, scanning conditions can also be set for each scene or frame.

Further, it is possible to determine whether an image to be displayed is a still image or a moving image. In the case of a still image, the scanning conditions shown in FIG. 3 are selected to obtain high resolution. In the case of a moving image, the scanning conditions shown in FIG. 4 are selected to obtain the maximum brightness.

Seventh Embodiment

In the above described embodiments, light is to be emitted onto the scanning lines corresponding to the scanning wirings on which write scanning is to be performed. However, the present invention is not limited to that structure.

For example, the present invention may be applied to a liquid crystal display panel of an active matrix driving type. In the case of a normal active matrix display apparatus, each scanning wiring is selected for a write operation, and a signal is written on an element (a pixel) connected to each selected scanning wiring. After that, light emission (light transmission from the backlight) is performed until the next write operation. In a case where the present invention is suitably applied to a liquid crystal panel of an active matrix driving type, backlight is not emitted onto the entire surface. Instead, linear light sources are arranged so as to emit light sequentially. In such a case, the circuit that performs a selecting operation to cause the light sources to emit light in order is equivalent to the scanning circuit of the present invention. The lines irradiated with the light emitted from the light sources are the scanning lines onto which light is to be emitted. Accordingly, the light sources to emit light are sequentially switched, so as to sequentially select the scanning lines onto which light is to be emitted.

In this structure, the number of light sources that emit light simultaneously is changed based on the evaluation value indicating the brightness of the screen or the information indicating the attribute of each program, as described in the foregoing embodiments. By doing so, the number of scanning lines onto which light is to be emitted can be changed.

The present invention may also be applied to an organic EL panel of an active matrix driving type.

In the case of an organic EL panel of an active matrix driving type, write scanning is performed in the same manner as in the case of a liquid crystal display panel of an active matrix driving type. Unlike a liquid crystal display panel, an organic EL panel is a self-luminous display. Therefore, backlight control is not performed, and scanning wirings for enabling light emission are employed separately from the scanning wirings for write operations. The circuit that applies a selection signal to the scanning wirings for enabling light emission is equivalent to the scanning circuit of the present invention. The number of scanning wirings for enabling light emission to which a signal (a selection signal) for allowing light emission is applied is controlled so as to control the scanning lines to be selected simultaneously.

Although the present invention have been described by way of various specific examples, it is not limited to the above described embodiments, and various changes and modifications may be made without departing from the scope of the present invention. For example, the numerical values shown with the above embodiments are merely examples, and, if necessary, different numerical values from the above may be employed.

This application claims priority from Japanese Patent Application No. 2004-55400 filed Feb. 27, 2004, and Japanese Patent Application No. 2005-27351 filed Feb. 3, 2005, which are hereby incorporated by references, herein.

What is claimed is:

1. An image display apparatus comprising:

a display panel comprising a plurality of pixels arrayed in a plurality of n scanning lines, n being an integer of 3 or greater;

a scanning circuit for outputting a selection signal for selecting one or more of these scanning lines in each of a sequence of predetermined selection periods in which from the pixels the selected scanning lines are to be activated;

an evaluation circuit for outputting an evaluation value corresponding to the brightness of an image formed by all pixels on the display panel at a predetermined period relating to a frame period; and a control circuit for changing scanning conditions in the scanning circuit in accordance with the evaluation value by changing the number of scanning lines being simultaneously selected during the predetermined selection periods without changing the frame period, wherein a plurality of scanning lines are selected when the evaluation value is greater than a predetermined value and one scanning line is selected when the evaluation value is equal to or smaller than the predetermined value.

2. The image display apparatus according to claim 1, wherein, the control circuit is adapted to change the scanning conditions so that said total time changes, in accordance with which range the evaluation value falls within among a plurality of ranges defined by a plurality of predetermined values.

3. The image display apparatus according to claim 1, wherein the control circuit is adapted to change at least either the number of scanning lines to be simultaneously selected or the number of scanning lines to be selected in both of two consecutive selection periods.

4. The image display apparatus according to claim 1 further comprising a luminance control circuit adapted to reduce a luminance difference caused when the scanning conditions in the scanning circuit are changed.

5. An image display apparatus comprising:

a display panel comprising a plurality of pixels arrayed in a plurality of n scanning lines, n being an integer of 3 or greater;

a scanning circuit for outputting a selection signal for selecting one or more of these scanning lines in each of a sequence of predetermined selection periods in which the pixels on the selected scanning lines are to be activated;

a tuner for receiving digital broadcast signal;

a de-multiplexer for extracting attribute information including genre information of a broadcast program from the digital broadcast signal; and a control circuit for changing scanning conditions in the scanning circuit in accordance with the genre information by changing the number of scanning lines being simultaneously selected during the predetermined selection periods without changing the frame period, wherein a plurality of scanning lines are selected when the genre of the broadcast program to be displayed on the display panel is sports and one scanning line is selected when the genre is cinema.

* * * * *